US005217307A

United States Patent [19]

McClintock

[11] Patent Number: 5,217,307

[45] Date of Patent: Jun. 8, 1993

[54] CONTAINER WITH AN EASY OPENING INDICATOR OR SECURITY BREAK INDICATOR

[75] Inventor: Jack M. McClintock, Stow, Ohio

[73] Assignee: Morgan Adhesives Company, Stow, Ohio

[21] Appl. No.: 809,424

[22] Filed: Dec. 17, 1991

Related U.S. Application Data

[63] Continuation-in-part of Ser. No. 624,051, Dec. 7, 1990.

[51] Int. Cl.[5] ..... B65D 33/20

[52] U.S. Cl. ..... 383/81; 383/5; 383/78; 383/207; 215/232; 215/246; 215/251; 215/256; 220/257; 220/270; 220/276; 206/831; 229/123.2; 229/123.3; 229/80.5; 428/40; 428/43

[58] Field of Search ..... 215/232, 246, 251, 254, 215/256; 206/831; 220/257, 270, 276; 229/123.2, 123.3, 80.5, 87.05; 383/5, 66, 78, 81, 207, 208, 209; 428/40, 43

[56] References Cited

U.S. PATENT DOCUMENTS

| | | | |
|---|---|---|---|
| 587,368 | 8/1897 | Jackson . | |
| 725,687 | 4/1903 | Emerick . | |
| 1,827,636 | 10/1931 | Ames . | |
| 2,121,041 | 6/1938 | Morgan | 215/246 X |
| 2,863,582 | 12/1958 | Owens | 215/246 X |
| 3,148,824 | 9/1964 | Foster et al. . | |
| 3,155,273 | 11/1964 | Cote . | |
| 3,711,011 | 1/1973 | Kugler | 383/66 X |
| 3,841,936 | 10/1974 | Fergg et al. . | |
| 3,873,018 | 3/1975 | Donnay | 215/232 X |
| 4,359,358 | 11/1982 | Hattemer | 206/831 X |
| 4,485,926 | 12/1984 | Lenzmeier | 206/602 |
| 4,572,377 | 2/1986 | Beckett | 206/610 |
| 4,640,411 | 2/1987 | Fery | 383/78 X |
| 4,758,456 | 7/1988 | Muscala . | |
| 4,884,826 | 12/1989 | Slagsvol . | |
| 4,902,142 | 2/1990 | Lammert et al. . | |
| 4,938,506 | 7/1970 | Matsuguchi et al. | 283/105 |
| 5,021,273 | 6/1991 | Kobayashi . | |
| 5,035,518 | 7/1991 | McClintock | 383/70 |
| 5,035,935 | 7/1991 | Thomas et al. . | |

FOREIGN PATENT DOCUMENTS

| | | |
|---|---|---|
| 3127626 | 1/1983 | Fed. Rep. of Germany . |
| 1175306 | 3/1959 | France . |

*Primary Examiner*—Stephen P. Garbe
*Assistant Examiner*—Stephen Cronin
*Attorney, Agent, or Firm*—Oldham, Oldham & Wilson Co.

[57] ABSTRACT

This invention provides tamper-safety labeling that can easily be applied to a container and closure means to disclose the opening of the container. This labeling is a single piece one that has a generally parallel perforated tear strip and tab formed from the face stock and that allows the tear strip and usually perforated member to be formed and laminated to a release liner having a release thereon at least commensurate with adhesive positioned in the laminate on each side of the tear strip in the face stock. Also, the tear strip may run at any angle from the horizontal plane of the container to permit the tear strip to be removed to present different arrangements of the labeling on the container and may become a product or origin identification for the container. An important aspect of the invention is that the label will normally include two separate areas of pressure sensitive adhesive, each having good adhesion characteristics to the container and closure means respectively, and normally no adhesive on the tear strip.

5 Claims, 4 Drawing Sheets

CONTAINER WITH AN EASY OPENING INDICATOR OR SECURITY BREAK INDICATOR

This is a continuation-in-part of my previous application Ser. No. 624,051 filed Dec. 7, 1990.

FIELD OF INVENTION

This invention relates to a container having a closure means with easy opening features and a means to indicate if the container and closure means have been tampered with after the tamper or security indicator has been attached or placed on or over the closure means and the container to allow easy observation of a security breach.

Bottle and/or container manufacturers generally do not make the caps and the container of the same plastic. This often times present problems since pressure sensitive labels normally contain only one type of pressure sensitive adhesive to bond to two dissimilar surfaces. In this normal situation it has been desirable that the label bond to both surfaces with the same strength and/or application without lifting in use or time. The novelty of the invention teaches that the adhesive formulation is designed for and made compatible with the surface of each section of the container where the label is applied.

An important aspect of the invention is that the label will normally include two separate areas of pressure sensitive adhesive, each having good adhesion characteristics to the container and closure means respectively, and normally no adhesive on the tear strip.

Hence, the novel invention contemplates the design of two adhesives to adhere and/or be compatible with different adherent surfaces such as the closure cap of the container and the holding portion of the container. One adhesive may be an acrylic and the other a rubber based and/or emulsion. This invention provide the opportunity to adhere to numerous different surfaces that are generally found on plastic and glass containers.

Another aspect of this invention relates to an adhesive attachable tamper indicator composed of a laminate of a strength member, better designated as face stock, two portions of pressure sensitive adhesive applied spaced apart on a surface of the face stock and having a release member associated therewith to protect said adhesive until removed to apply and adhere said face stock over said closure means on said container to retain said closure means in fixed relation to said container and a tear member, viz. a tear strip that has parallel perforations in the face stock, with a finger grip or tab formed at the end of the tear strip so that it can be torn from said face stock to separate said face stock into two portions having adhesive thereon. Then a portion of the closure member, viz. the strip, can be removed from the container. Before the tab is pulled to break the tear strip out, one can easily see if the original package has had its security breached and would then evaluate whether to use the package contents. Because the adhesive is selected to be compatible with the surface to which it is applied, normally a removable adhesive will be associated with the portion attached to the closure means so it can be fully removed during use, and if associated with an individual pill dispensing container, for example, the portion associated with the closure could include patient name and/or other information, and when removed from the enclosure, could be adhered to a patients chart to show the prescribed medicines or pills had been delivered, opened and taken.

In another embodiment of this invention, the tear strip and tab part of the label may contain a returnable coupon feature or the returnable coupon feature may be a separate feature or part associated with tear strip and tab, and/or the removable adhesive portion can be attached to a returned letter, etc.

BACKGROUND OF THE INVENTION

My pending application Ser. No. 07/481,492 filed Feb. 16, 1990 illustrates some of the types of reclosure means and containers where tampering or safety is a problem. In this disclosure, both permanent and pressure sensitive adhesives are taught to be useable. This copending application is also an improvement on U.S. Pat. No. 4,758,456 and the tamper evident strip thereof. The packaging industry has sought improved, more economical and easier to apply and remove closure means and means to indicate whether the container contents have been tampered with or have had their security breached. For instance, the soda pop and related bottle industry, produces bottles called twist-top bottles having a clamp-on cap with a skirt extending below a circular flange on the bottle. This skirt clamps down to lock the screw-on cap in place, until the skirt is severed or broken to permit the cap to be unscrewed to open the bottle. These type tamper indicators are generally metallic in nature in the prior art, whereas it will generally be plastic or paper in the present invention.

Another tamper or safety indicator used commercially is a heat shrink film that is placed on the closure means and the container after the container is filled and then heat shrunk to cause the film to essentially conform to the shape of the container and closure means to prevent the closure means from being removed until the film is severed or torn from the bottle. This severing of the film generally requires a tool or a knife to tear the film sufficient to get a hand hold to tear it off or to sever the film around the periphery of the single line between the exposed edge where the closure means and the container meet.

Frequently, this severing and tearing results in disfigurement of the labels or the label becomes unreadable, or partially or totally lost during the tearing operation. Another disadvantage of these closure systems is that the place to be severed may be hard to see for the elderly and also hard to tear or sever.

James A. Muscala's U.S. Pat. No. 4,758,456 provides an improved safety or tamper means for closing and labeling a bottle and cap assembly. This assembly has several disadvantages which are reduced or removed by the present invention. For example, in this invention there is no need to undercut the release member and have the release agent present under the tear strip, which is ungummed in the current invention. Also, in Muscala, where there is no removable portion of label on the cap, the opened tear strip distracts from the aesthetic appearance of the bottle.

U.S. Pat. No. 1,827,636 teaches an adhesive label for sealing packages which includes an uncoated tear strip with adhesive areas on both sides thereof, but there is no teaching or suggestion that the characteristics of the respective adhesive areas would be different or made compatible to the surfaces to which they are attached. There is no suggestions for any removability of a part of the label, and wherein such part could then perform another use such as being separately attached to a patients medical chart to positively show that prescription dosage pills were removed from the container and taken by the patient.

U.S. Pat. No. 3,841,936 teaches an adhesive label with an ungummed removable tear strip, but again has no teaching or suggestion of making the adhesive compatible with the surface of the material to which it is attached, or that a portion has a removable peel strength so a portion of the label could be easily removed.

In conclusion, there is no convenient easy open strip to effect removal of the strip and also indicate evidence of tampering, and also have an adhesive system which is compatible to the surfaces to which it is attached.

SUMMARY OF THE INVENTION

It is an aspect of the present invention to provide an inexpensive, easy opening and tamper resistent indicator for a closure and its closure means, where the container can be a box, package, glass bottle, plastic bottle or other container for food, household, pharmaceutical, cosmetics or other packaged materials where the purchaser and/or consumer fears contamination, soiling or alteration and desires easy opening and tamper resistance.

Another aspect of this invention is to provide a tamper indicator or illegal access indicator means that is simpler and easier to manufacture as fewer steps are needed and which shows or discloses wrongful or undesired access to the contents of the container.

Another object of the invention is to utilize both permanent and removable pressure sensitive adhesives whereby the portion with removable adhesive can be fully removed from the container to facilitate opening and closing the container, and to expose other printing or an extra coupon under the removable portion, but both adhesives are designed to be compatible with the surfaces to which they are applied.

An additional aspect is that this tamper indicator means can serve as a unitary decorative label for said container and closure means, yet can be severed to leave the container and/or closure means each with its specific labeling thereon while the tear strip and tab may have its own message.

A further aspect is that the tamper indicator sealing means can be applied to the container and closure means with the production of a single piece of label, which includes a release member and can be severed to permit the closure means to be readily and easily removed with the production of a single tear strip with its tab instead of a laminated one composed of a tear strip, adhesive layer and release member of the prior art.

Also, because this tamper or safety indicator is not a laminate, it can be applied by standard and well known label dispersion machinery, with fewer removed parts and with less damage or blocking of the line which reduces costly line down time. Also an aspect of this invention, is that the container is easier to open, particularly for the aged and handicapped.

These aspects and other objects can be accomplished with the present invention which comprises, in one embodiment, a generically designated container for holding the product, with a closure means for at least one of the open ends of the container and tamper or safety indicator label. Further, this tamper indicator offers features and advantages not found in the prior art indicators, namely each of the two parts of the strength member can be used not only collectively to provide tamper and safety indication but to provide product designation such as quality, source, grade, advertising and use advice. Thus, the lower part of the strength member can be the label on the container before and after severing of the strength member by pulling the tear strip. Also, the part of the strength member on the closure means before and after the face stock is severed, is a label for the closure means or a label for the cover. In this specification, "label" is used in all its aspects such as the usual label to identify the contents, provide instructions and precautions and advertise using text or illustrations. Also, the adhesives are preferably made compatible with the surfaces to which they are applied, such as removable to the top or cap, and permanent to the base.

BRIEF DESCRIPTION OF THE DRAWINGS

Reference to the accompanying drawings will further illustrate the novel features of this invention, its advantages and details of construction and use.

DETAILED DESCRIPTION OF THE PREFERRED EMBODIMENT

Figure 1:
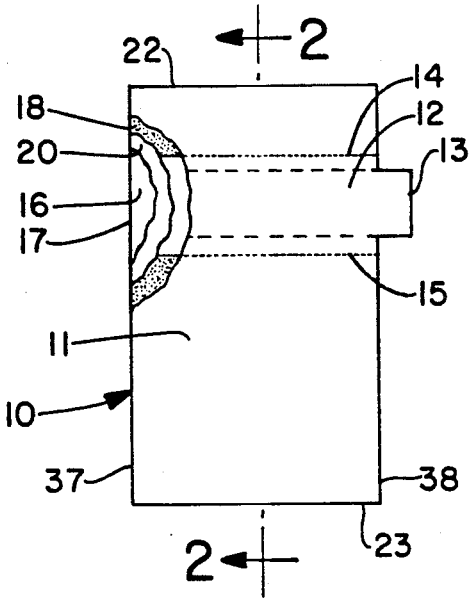
FIG. 1 is a plan view with part in section to further show the nature of the tear strip and its relationship to the adhesive layer and the release member as well as the two portions of the strength member.
Figure 2:
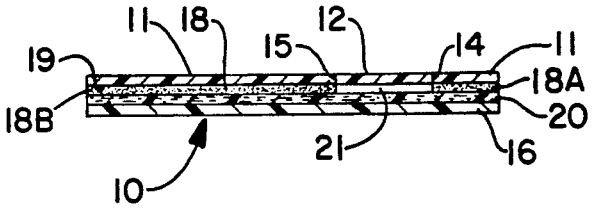
FIG. 2 is an elongated cross-sectional view of FIG. 1 through the tear strip.
Figure 9:
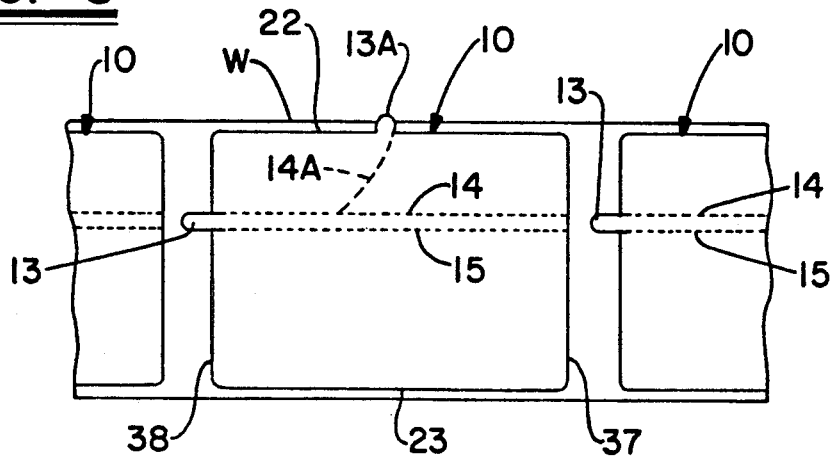
FIG. 9 is a partial view of a web laminate showing the face stock cut into labels thereon.

Referring now to the drawings of FIGS. 1 and 2 that illustrate a generic as well as specific embodiment of this invention and show the tamper and safety indicator 10 in essentially rectangular shape composed of a face stock 11, such as a plastic film or paper sheet having a tear strip 12 with a finger grip or tab 13 positioned thereon. This tear strip and tab is formed by creating tear lines 14 and 15, preferably in parallel lines, in the face stock by perforating, impressing, cutting or punching the face stock in well known ways as shown in FIG. 9 where W is the web and 10 is the unitary label.

Figure 10:
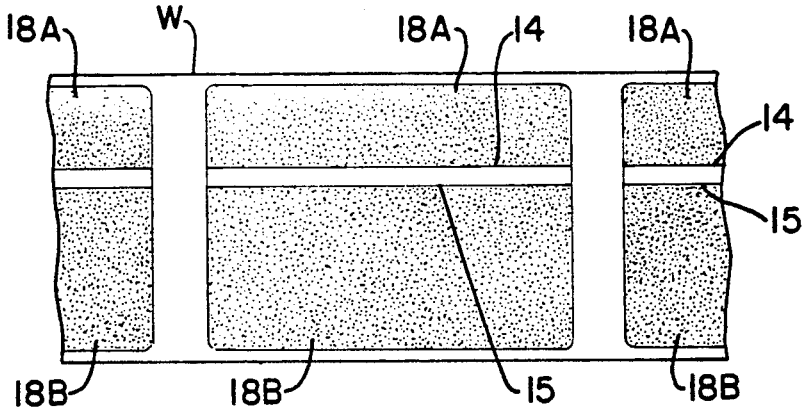
FIG. 10 is a partial view in section of the web having the release member with the adhesive applied in spaced apart parallel portions thereon, without the face stock thereon.

In the sectional or cutaway of FIG. 1, the tear strip 12 of the face stock 11 is shown removed to show the release member or lines 16 of the laminate 17 which is shown more precisely in FIGS. 2 and 10. Also, in FIG. 2, the adhesive layer or layers 18 (preferably one of a permanent pressure sensitive adhesive and one of a removable pressure sensitive adhesive, are shown adhered to the underside 19 of the face stock (seen best in FIG. 2) with the release coat 20 on the release member 16 covering or protecting the adhesive layer. The number 21 (best seen in FIG. 2) designates the part of the underside 19 of the face stock that has no adhesive thereon or is ungummed. Hence, my invention has no adhesive on the tear strip. Thus, the adhesive of the face stock extends from the edge 23 to the line 15 and from edge 22 to the line 14 to leave the part 21 uncoated with adhesive. This arrangement causes there to be no adhesive under tear strip 12. The release coat 20 and release member 16 preferably extend continuously from edge 22 all the way to edge 23, but the adhesive coat may stop at lines 14 and 15 as shown in FIG. 10, to leave the tear strip area uncoated. The adhesive areas can be of the well known permanent pressure sensitive adhesive of the permanent and/or removable types on the same label.

Figure 3:
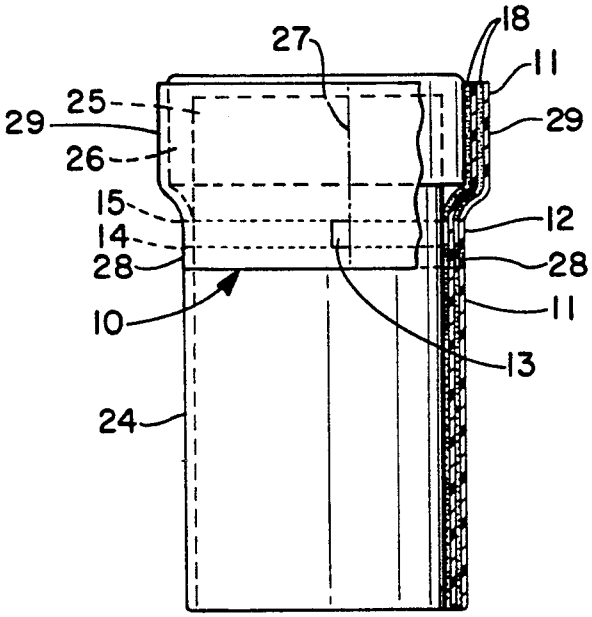
FIG. 3 is an elevational side view in partial section of a rectangular container having a closure means thereon (viz. a lid) and a tamper and safety indicator position thereon adhered to the lid and container as shown.

The tamper or safety indicator 10 of FIGS. 1 and 2 is shown in FIG. 3 positioned on a cylindrical container 24 that has been filled with a product such as a natural fiber regulator, pharmaceutical, prescription drugs, medicine, food, cosmetics, etc. and the open end 25 closed with a lid or cap 26 which can screw on, slip on or be glued on.

Specifically, referring to FIG. 3, the tamper or safety indicator 10 is shown wrapped around the container and lid with the vertical edges, overlapped designated by line 27, as seen in FIG. 3. The release member 16 and release coating 20 is removed prior to wrapping the face stock into a cylinder around the container and lid to place the adhesive in contact with the lid so the adhesive 18 can adhere to the outside of the lid. It is preferable that the wrapping on the container and lid form an overlapped seam 27. Since, in FIG. 3, the outside of the lid is greater than the diameter of the container, it is desirable to use one of the well known heat shrinkable films and heat shrink the film to cause the film to fit tightly on the container as well as the lid as shown by positions 28 and 29, respectively, with the face stock adhered to the lid and container by the two portions 18A and 18B of the adhesive (preferably one permanent, and one removable). With the tamper and safety label adhered to the container and lid as shown in FIG. 3, the container cannot be opened without destruction of the face stock adhered to the container and its lid. However, the majority of bottle caps are in line with the neck and would not need shrinkable film.

The container may be easily opened by taking or grasping the tab 13 and pulling to tear the tear strip 12 away from the face stock 11 by tearing it along the lines 14 and 15 to separate the face stock into an upper 29 and lower 28 portion to free the lid to be removed to open the end 25 of the container. Removal of the tear strip leaves the label portion with a smooth parallel shape of nice appearance.

It should be noted, however, that in some instances it will be desirable for the adhesives 18 and 18A to be removable and permanent types respectively. In this way once the tear strip 12 is removed, the upper portion 29 can also be removed because of the removable adhesive used so as to facilitate removal and repositioning of the cap 26, and also to expose any other printing or an extra label or coupon associated with the cap 26.

In addition, the removable portion 29 can contain information which can then be attached elsewhere because the removable adhesive will permit such reattachment to another surface. Consider, for example, a plastic bottle/container carries dispensing controlled quantity of individual pill medications with such medication and other data on the tamper evident label applied after the container has been filed by the drug manufacturer. In use, one removes the tamper evident tab, dispenses the pills, then removes the removable adhesive with corresponding information and it could be adhered to the patients chart to positively indicate the dosage had been delivered, the container opened, and the pills taken by the patient.

Figure 4:
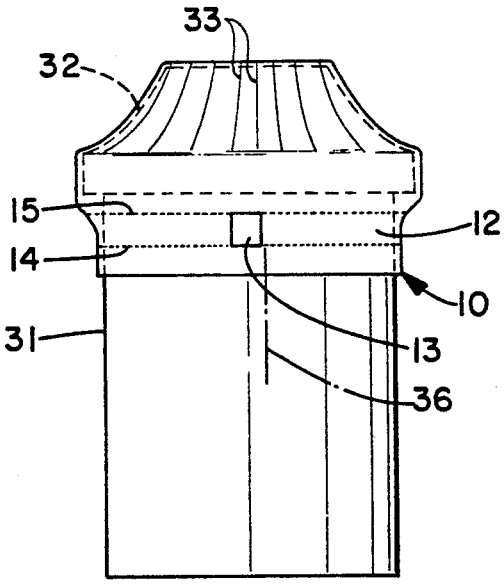
FIG. 4 is an elevational view of a cylindrical container having tapered shoulders with a screw lid thereon and a plastic tamper indicator or label member wrapped around said container, heat shrunk to cause the plastic to shrink to the taper of the shoulders and to fit the lid and be adhesively adhered to the lid and container.

FIG. 4 shows a container 31 with an open end that tapers inward so that upper lid portion 32 is slightly smaller than the container dimensions. In this view, the tapered lid 32 has a tamper indicator 10 heat shrunk thereon. The tamper indicator 10 is shown with a series of cross_lines 33 to give the lid portion thereof a label effect. Thus the label effect may serve as an identifying design or trademark with print, pictures or design thereon. Hence, the safety indicator labeling can serve as a container and/or lid label.

Figure 5:
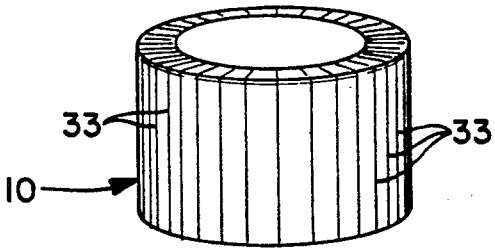
FIG. 5 is a perspective view of a lid showing the plastic tamper member folded over on top of the lid and as labeling even when the container has had the lid removed to open it.

FIG. 5 illustrates how the remaining label on the lid can serve as a label before and after the tear member is removed on the side as well as at least part of the top of the lid.

Figure 6:
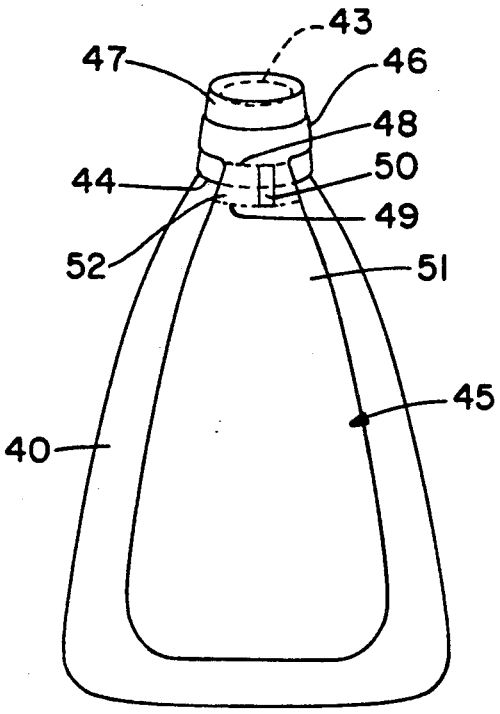
FIG. 6 is an elevational view of a tapered bottle with a plastic screw cap thereon having a unitary label extending over the sides and adhered to said bottle and cap having a tear strip to sever the unitary label into a cap portion and a bottle portion with the tear edges being essentially parallel to each other.

FIG. 6. shows a tapered bottle 40 of either glass or plastic, such as a blown polyethylene terephthalate closed with a molded plastic cap 41. This bottle has been fitted with a special embodiment of the tamper and safety label indicator. This label furnishes visual proof of whether the bottle has been opened since the unitary label was placed on the bottle and that the contents of the bottle have not been accessed by someone after the unitary label was placed thereon.

Referring again to FIG. 6, it will be seen that the mouth 43 of the bottle is closed by screw cap 47 and that line 44 indicates the bottom of the cap and that this special embodiment of the label is not generally rectangular as shown in FIG. 1. Instead, in this specific embodiment, it has a shape more like that of FIG. 7. The face stock may be a sheet of film, plastic or paper 45 having the configuration shown with the T-shaped top portion 46. The T-shaped top portion is the portion that wraps around the neck part 47 of the bottle. The parallel tear lines 48 and 49 are the weakened portion that tears when the hand member 50 is pulled to sever the T-shaped top 46 from the body part 51 to break the locking relationship between the screw cap and the bottle. The tear strip is designated 52 and when it is torn away, the cap can be unscrewed.

Figure 8:
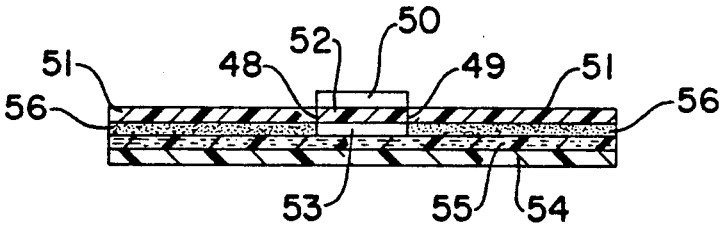
FIG. 8 is a cross-sectional view of FIG. 7 along lines 7—7.

As seen in FIG. 8, the adhesive 56 intended to contact the lower portion of the bottle 40 will be a permanent adhesive designed to be compatible with and vigorously and permanently adhere to the bottle 40, while the adhesive 56A intended to contact the cap 41 will be a removable adhesive that is designed to be compatible with the material surface of the cap so it will suitably adhere thereto, but may be removable for various other reasons, examples as given above. The key, however, is that both adhesive systems are formulated so as to be compatible with the surface to which they are adhered.

The nature of the laminate shown in FIG. 7 can be better explained by reference to FIG. 8, where the area which is ungummed or has no adhesive is indicated by numeral 53. Numeral 54 is the release member with a release coat 55 thereon and extending as a continuous member from one end of the adhesive across 53 to the other end of the adhesive.

Figure 7:
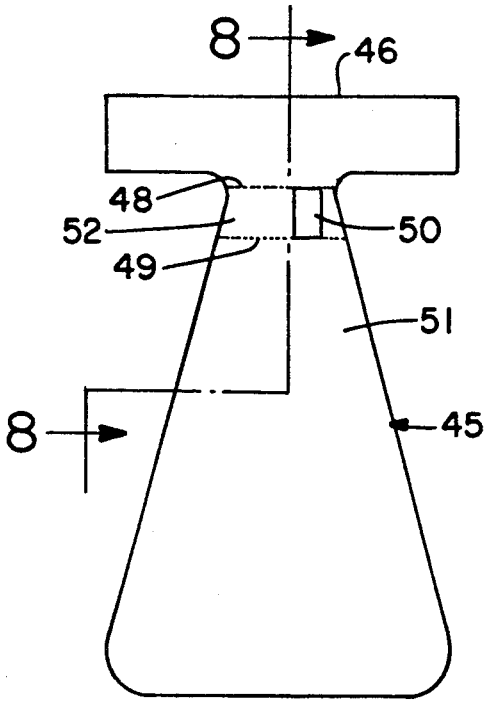
FIG. 7 is a plan view of the unitary label of this special embodiment like FIG. 6 showing a T-sector to cover the cap and the tear strip with tab.

Once the bottle is filled and the cap placed thereon, the label means 45 of FIGS. 7 and 8 is placed thereon by removing the release member 54 and release coat 55, pressing the adhesive layer on the face of the bottle and wrapping the T-shaped cap 46 around the screw cap 47 as shown in FIG. 6. With the tamper indicator means adhered to the bottle and cap, a person can readily tell when the contents have been tampered with by someone. The tamper control is broken by pulling tab 50 to lift the tear strip 52 away.

Since the strength member is permanently bonded to the container, the printing, picture or design will always be present. The face stock or the strength member may be paper, plastics, vinyl, polyester or related film material. The release coat preferably is the well known silicone or other well known release agents. The adhesive may be any of the well known types such as a pressure sensitive adhesive of the acrylic removable or permanent type or emulsion permanent or removable rubber based permanent and emulsion removable, or any other combination on the face stock. The nature of the differences between removable and permanent pressure sensitive adhesives are described in my application Ser. No. 07/481,492 filed Feb. 16, 1990 which is specifically incorporated herein to supplement this application.

FIG. 9 illustrates how the label 10 is carried on a web W. Preferably it is formed by being die cut with the excess material stripped. The tab 13 is formed with the perforations 14 and 15 to create the tear strip 12. As a means of assisting in removing the upper portion of the label (when coated with removable pressure sensitive adhesive) a tab 13A with perforations 14A may be provided.

FIG. 10 simply represents the web W showing the reverse side of the label thereby showing the removable pressure sensitive adhesive 18A and the permanent pressure sensitive adhesive 18B.

Figure 11:
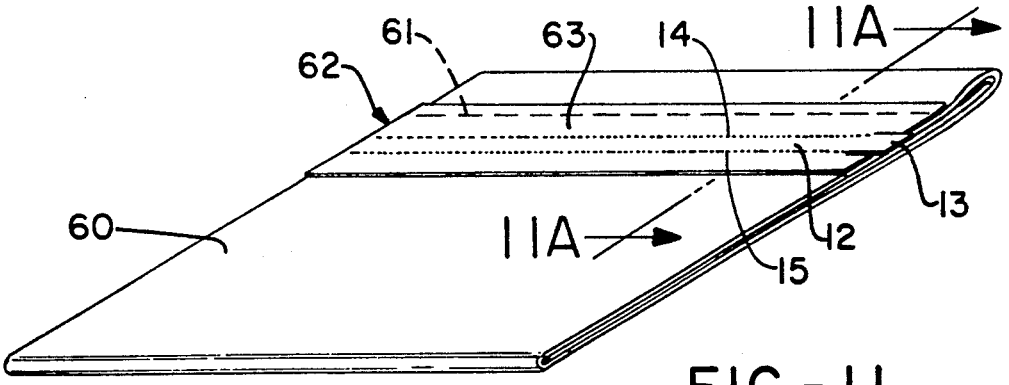
FIG. 11 is a partial perspective view of a flexible folded bag having its open end folded over or closed with the labeling of this invention thereon.

FIG. 11 shows a specific embodiment where a flexible or similar plastic or paper bag 60 is filled with a product and the open end 61 rolled down to close that end. The label 62 is applied by removing the release member and release agent to expose the adhesive. Then the label is applied as shown in this figure to close said bag and provide visual proof that the bag has not been opened since the label was attached. When the bag is opened, tab 13 is pulled to remove tear strip 12 by breaking the label along lines 14 and 15 to allow the bag to be opened. A reclosure 63 is formed when the tear strip 12 is removed. When the adhesive on section 63 is of the removable pressure sensitive type, the bag or package can be resealed by pressing the adhesive back into contact with the surface of the bag.

Figure 11A:
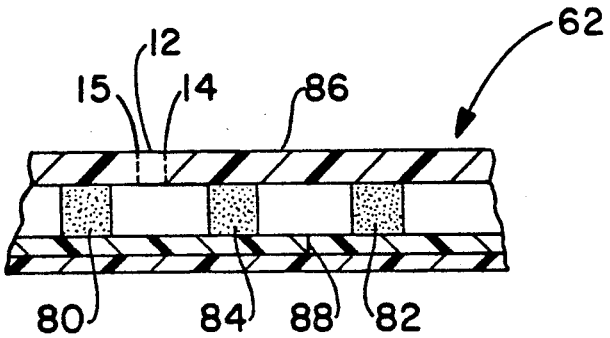
FIG. 11A is a broken away plan view of the closure system of FIG. 11 showing the arrangement of the adhesive coated, uncoated and perfed areas respectively.

FIG. 11A illustrates the arrangement of the respective adhesive coatings and ungummed areas making up the closure and reclosure system of FIG. 11. Note there are two sections of permanent adhesive 80 and 82, and one section of removable arranged with the ungummed tear strip and the ungummed lift tab 86.

Hence, when the tear strip 12 is removed the lift tab 86 can be grasped to open the package with the slit or perfed opening shown at 88, and then the removable adhesive 84 can be reapplied to the surface of the bag below slit 88 to reclose the bag.

Labeling sometimes includes proof of purchase, coupons, prizes and/or games. The tear strip of this invention may be adjusted in size to permit proof of purchase, coupons, prizes or games to be printed thereon. Alternately, the tear strip may release a coupon held thereon separate from the face stock per se.

Figure 12:
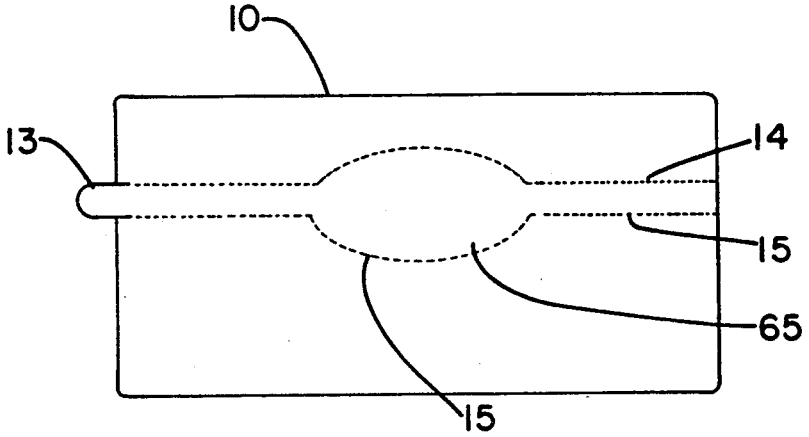
FIG. 12 is a plan view of an embodiment where the label contains a tear out coupon that is removed by the tear strip.

FIG. 12 shows the embodiment where the tear strip 12 can be removed by use of tab 13 to free coupon 63 from the face stock. It is appreciated that the printing on the coupon will define its value and validity.

Figure 13:
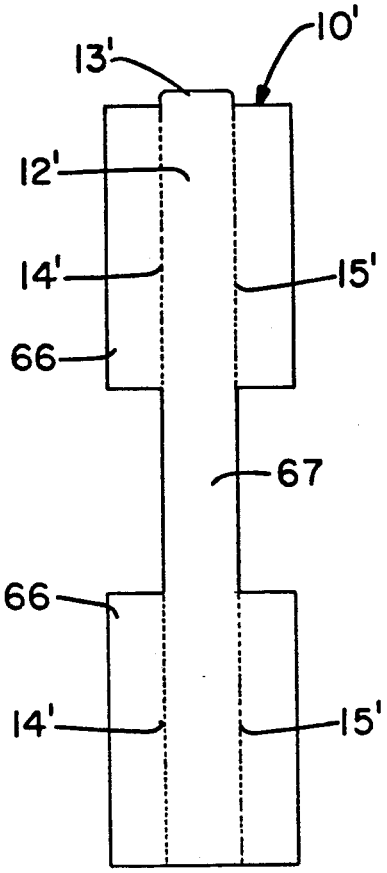
FIG. 13 is a plan view of an embodiment where the tear strip is positioned vertically on the label.
Figure 14:
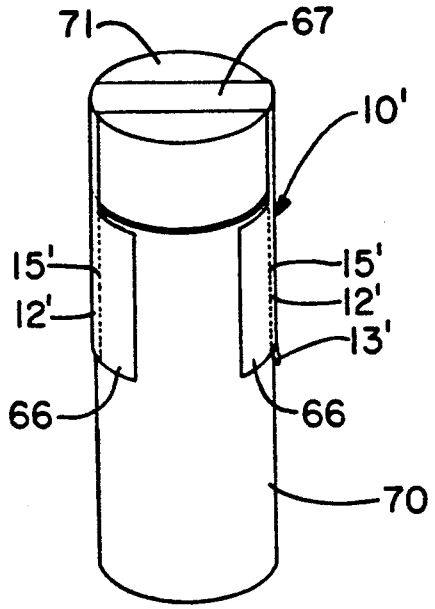
FIG. 14 is an elevational view of the label of FIG. 13 on a container with the tear strip placed vertically.

FIGS. 13 and 14 show a label having a tear strip positioned to fit on the container in a non-horizontal plane of FIGS. 1, 3, 4, 6, 7, 11 and 12. Thus, the strip may go over the top of the container as shown in FIG. 14, or the strip may run at an angle between the vertical and horizontal plane where the angle may vary through 90° say, 10°, 20°, 30° or 45°.

In designing the respective removable and permanent adhesive characteristics to be compatible with the surface to which they are applied the following criteria should be followed;

a) Removable should have a peel of between about 150 to 400 grams/½ inch, and be repeatably resealable at least 10 to 20 times while maintaining within 10% of the same peel tension. It should be understood that a peel test is conducted by applying a pulling force in the plane of the applied position of the label to attempt to peel the label from its applied position.

b) Permanent should have a peel strength of greater than 1 lb/½ inch and/or create a destruction of either the label or the substrate without adhesive separation.

It has also been determined that the tear strip 12 must have a minimum width of about ⅛ inch and a maximum width of about ½ inch and preferably about 3/16 to ¼ inch. This is so the strip itself will have enough tensile strength to tear along the perforation without tearing itself, and also because it is difficult to control non-coating of adhesive to less than ⅛ inch without the permanent and removable adhesives bleeding into each other and hampering the effect of the tear strip.

While in accordance with the patent statutes, the best mode and preferred embodiment of the invention have been described, it is to be understood that the invention is not limited thereto, but rather is to be measured by the scope and spirit of the appended claims.

WHAT IS CLAIMED IS:

1. A container and closure means to permit said container to be opened and reclosed, having a tamper-safety indicator comprising a face stock extending over a closure line between said container and said closure means, said face stock having a tear strip with a tab formed thereon to divide said face stock into two parts when said tear strip is torn therefrom, one surface of said face stock having at least one type of adhesive applied thereto for compatible permanent adherence to the container, but not applied to the tear strip, and a second type of adhesive applied to the second portion of the face stock for compatible releasable adherence to form a releasable laminate with said face stock and the container, said tear strip being removable from the face stock to form two portions to allow the container to be opened, wherein the face stock has at least two areas uncoated with adhesive, at least three areas coated with pressure sensitive adhesive with at least one of said at least three areas being a removable pressure sensitive adhesive whereby when the tear strip is removed the container can be opened, but reclosed using the removable pressure sensitive adhesive area to reclose against the container.

2. The container and closure means of claim 1 wherein the tamper safety indicator is a label having printing and/or pictorial messages thereon.

3. The container and closure means of claim 1 wherein the tear strip is formed by perforations in the face stock.

4. The container and closure means of claim 1 wherein at least one of the uncoated areas of the face stock acts as a lift tab to facilitate lifting the face stock and the area of removable pressure sensitive adhesive to effect opening the container.

5. The container and closure means of claim 4 wherein a first area of permanent pressure sensitive adhesive is adjacent an edge of the face stock, the uncoated area of the tear strip is adjacent the first area, the uncoated area of the lift tab is adjacent to the tear strip, a second area of removable pressure sensitive adhesive is adjacent the lift tab, a second uncoated area is adjacent the removable adhesive area, and a second area of permanent pressure sensitive adhesive adjacent the second uncoated area wherein, the removable adhesive area can be repeatedly removed and reattached to the face stock when the tear strip has been removed.

* * * * *